US006502871B1

(12) United States Patent
Malmanger

(10) Patent No.: US 6,502,871 B1
(45) Date of Patent: Jan. 7, 2003

(54) ROTARY LATCH SYSTEM AND METHOD

(75) Inventor: John A. Malmanger, Seattle, WA (US)

(73) Assignee: Tempress Products, LP, Dallas, TX (US)

( * ) Notice: Subject to any disclaimer, the term of this patent is extended or adjusted under 35 U.S.C. 154(b) by 10 days.

(21) Appl. No.: 09/723,848

(22) Filed: Nov. 28, 2000

(51) Int. Cl.[7] ..... E05C 3/04

(52) U.S. Cl. ..... 292/204; 292/44; 292/163; 292/203; 292/210; 292/256.5; 292/DIG. 31; 292/DIG. 30; 292/DIG. 53; 292/DIG. 61

(58) Field of Search ..... 292/204, 210, 292/256.5, DIG. 38, DIG. 61, 44, 163, 203, DIG. 31, DIG. 53

(56) References Cited

U.S. PATENT DOCUMENTS

| | | | | | |
|---|---|---|---|---|---|
| 2,744,406 | A | * | 5/1956 | Labrie | 70/96 |
| 2,772,809 | A | * | 12/1956 | Ross | 220/318 |
| 3,266,275 | A | * | 8/1966 | Atkinson | 70/70 |
| 3,369,654 | A | * | 2/1968 | Burgess | 206/406 |
| 3,389,932 | A | * | 6/1968 | Pastva | 292/173 |
| 3,540,578 | A | * | 11/1970 | Jones | 206/52 |
| 3,747,964 | A | * | 7/1973 | Nilsen | 285/337 |
| 3,797,870 | A | * | 3/1974 | Beckman | 292/128 |
| 3,862,555 | A | * | 1/1975 | Wirth | 70/63 |
| 4,320,834 | A | * | 3/1982 | Tamaki | 206/404 |
| 4,360,123 | A | * | 11/1982 | Blease | 220/323 |
| 4,407,535 | A | * | 10/1983 | Ohnuki et al. | 292/27 |
| 4,706,478 | A | * | 11/1987 | Swan et al. | 70/208 |
| 4,790,579 | A | * | 12/1988 | Maxwell et al. | 292/175 |
| 4,850,208 | A | * | 7/1989 | Weinerman et al. | 70/208 |
| 4,850,209 | A | * | 7/1989 | Weinerman et al. | 70/208 |
| 4,940,140 | A | * | 7/1990 | Posso | 206/405 |
| 5,046,340 | A | * | 9/1991 | Weinerman et al. | 70/208 |
| D324,636 | S | | 3/1992 | Schlack et al. | |
| 5,231,948 | A | | 8/1993 | Malmanger et al. | |
| D348,316 | S | * | 6/1994 | Malmanger et al. | D25/48 |
| 5,358,291 | A | | 10/1994 | Malmanger et al. | |
| D357,396 | S | | 4/1995 | Ziemer et al. | |
| 5,664,813 | A | * | 9/1997 | Gromotka | 292/229 |
| 5,878,608 | A | * | 3/1999 | Alyanakian | 70/208 |
| D445,017 | S | * | 7/2001 | Kronemeyer et al. | D8/337 |
| 6,305,725 | B1 | * | 10/2001 | Antonucci et al. | 292/67 |
| 6,334,277 | B1 | * | 1/2002 | Condino | 49/381 |

FOREIGN PATENT DOCUMENTS

| | | | | |
|---|---|---|---|---|
| DE | 3129671 | * | 2/1983 | 292/256.5 |

* cited by examiner

*Primary Examiner*—J. J. Swann
*Assistant Examiner*—Carlos Lugo
(74) *Attorney, Agent, or Firm*—Fulbright & Jaworski L.L.P.

(57) ABSTRACT

The present invention provides a latch system and method which is rotatably engaged/disengaged. Accordingly, the preferred embodiment provides a latch actuator, disposed in a latch cup of a surface to be provided restricted movement, and a latch bolt coupled to the latch actuator such that rotational manipulation of the latch actuator results in rotational manipulation of the latch bolt. Preferred embodiments of the present invention include a locking mechanism allowing controlled restriction of the rotational movement of the latch mechanism.

65 Claims, 9 Drawing Sheets

ROTARY LATCH SYSTEM AND METHOD

RELATED APPLICATIONS

This application is related to concurrently filed, co-pending, and commonly assigned U.S. patent application Ser. No. 29/133,332 entitled "Rotary Latch," the disclosure of which is hereby incorporated herein by reference.

TECHNICAL FIELD

The present invention relates generally to latches useful in providing controlled operation of a panel or hatch and, more particularly, to a latch operated by rotational movement of the latch mechanism.

BACKGROUND

Hatches are often used to provide controlled access to a compartment or other area. For example, hatches are used in the marine industry to provide an enclosed area which may be easily accessed through manipulation of a hatch door or similar panel. Such hatches are often relied upon to keep objects in the enclosed area until needed and/or to provide for the safe storage of such objects, free from environmental and other elements. In the marine industry, environmental elements from which protection is sought may include damaging solar rays, moisture (such as corrosive salt water spray), and/or movement, such as that associated with a marine vessel in movement over water.

One typical hatch design in common use today includes a hatch door or panel having a hinge mechanism disposed along one edge to facilitate controlled movement of the hatch door between an open and a closed position. Additionally, the typical hatch design generally employs a latch mechanism disposed along an edge of the hatch door or panel to allow the hatch to be maintained in the closed position.

One such hatch and latch arrangement is shown in commonly assigned U.S. Pat. Nos. 5,231,948 and 5,358,291, both entitled "Hatch with Improved Latch and Hinge Assembly," the disclosures of which are hereby incorporated herein by reference. The latch mechanism provided in the above referenced patents provides a linearly moving biased latch pawl which engages a frame or panel into which the hatch door is set to thereby provide a force to maintain the hatch in the closed position. This latch mechanism is sometimes referred to as a "slam latch" because of its ability to close and engage with the closing motion of the hatch door. The hatch and latch mechanisms of these embodiments are provided in plastics, such as may include ultra-violet light inhibitors or other protective additives, or other non-corrosive materials to provide a system adapted to withstand such environmental elements as sun and moisture.

Another latch mechanism often found on such hatch assemblies involves a rotatably mounted bolt to engage a frame or panel into which the hatch is mounted. Such a latch mechanism is sometimes referred to as a "dog down latch" because of its aggressive retention of the hatch in the closed position.

Directing attention to FIG. 1, hatch 100 is shown including latch 120 employing a typical prior art "dog down latch" embodiment. Specifically, hatch 100 includes hatch door 110 coupled to frame 130 by hinges 111. Disposed along an edge opposite that of hinges 111 is latch 120 including bolt 121 disposed to engage frame 130 when hatch door 110 is in a closed position and, therefore, maintain hatch 100 in the closed position. In order to allow the opening and closing of hatch door 110, bolt 121 is mounted on shaft 122 which is rotatably disposed through hatch door 110. D ring 123 may be gripped by a user of hatch 100 and, thereby, rotational force may be applied to shaft 122 to cause bolt 121 to engage or disengage frame 130 as desired.

In order to allow hatch 100 to be disposed on a deck, bulkhead, or other surface with as nearly a flush surface as possible, hatch door 110 may include recess 112 in which shaft 122 is disposed. However, in order to operate hatch 100, the user must pivot D ring 123 from within recess 112 in order to provide D ring 123 in a proper orientation to allow the user to provide sufficient rotational force to the latch. Thereafter, the user must pivot D ring 123 to return it to within recess 112 so as not to cause D ring 123 to extend beyond the surface of hatch door 110, such as might present a trip or snag hazard on a deck or bulkhead.

It should be appreciated that the visible portion of latch 120 when hatch 100 is closed includes only shaft 122 and D ring 123. Accordingly it is often not possible to determine when bolt 121 has engaged frame 130 as the appearance of shaft 122 and D ring 123 are substantially identical when bolt 121 has engaged frame 130 and when bolt 121 is disposed in an orientation 180° from engaging frame 130. Accordingly, a user can often attempt to latch hatch 100 and later discover that the hatch is not in fact latched.

Although a "dog down" type latch typically provides sufficient retention of the hatch door against the frame or panel into which it is mounted to provide an adequate seal against water infiltration around the hatch door, the latch itself is an area of potential water infiltration. Specifically, as the shaft or attached mechanism must penetrate the surface of hatch door 110 in order to couple with bolt 121, and there must be sufficient clearance for rotation of the shaft, there is a space through which water may pass. Accordingly, prior art solutions have typically engaged an O ring, made of a rubber or other resilient material, disposed around a portion of the shaft to engage a shaft hole edge in the hatch door to discourage water infiltration. The O ring is often disposed in such a way as to have substantial continuous and/or unequal pressure applied from the surfaces of the hatch door and/or the shaft both during rotation of the latch and when the latch is at rest. This pressure can result in premature failure of the seal as the friction often causes the material of the O ring to wear away. Similarly, often the water being discouraged from infiltration carries with it abrasive particles, such as sand and/or salt brine, further accelerating the wearing away of the seal. Moreover, the design of the latch assembly typically results in this O ring providing substantially the only defense to water infiltration.

Although not illustrated in the embodiment of FIG. 1, hatch 100 may be provided with a locking mechanism to discourage unauthorized access to an area enclosed thereby. It is difficult to employ a keyed locking mechanism on the shaft providing the rotational movement of the bolt. Accordingly, such locking mechanisms are often disposed separately from the latch, such as a separate lock cylinder and bolt disposed along an edge of the hatch door. Such an embodiment allows operation of the latch assembly, and thus its disengagement with the frame, relying upon the bolt of the locking mechanism to prevent opening of the hatch. Such an arrangement generally does not provide the level of security available with actually locking the latch mechanism. Additionally, prior art mechanisms are generally provided utilizing metal components which are prone to deterioration, such as through corrosion and/or rust when used in a marine environment. The prior art locking mechanisms also provide additional areas of potential water infiltration.

Accordingly, a need exists in the art for a latch system adapted to provide secure closing of a hatch door, even in rough and jarring movement, and to inhibit moisture from entering the enclosed area. A need exists in the art for the latch system to provide positive indication to a user of its engaged or disengaged status. Additionally, a need in the art exists for such a latch system to provide a substantially flush surface without requiring an operator to manipulate portions thereof to achieve such a flush surface. Moreover, a need exists in the art for the latch system to resist deterioration due to environmental elements.

A further need exists in the art for a latch system providing locked access such that persons not authorized to access the enclosed area are discouraged from opening the hatch door. A need in the art exists for a latch locking mechanism to be resistant to degradation, such as through exposure to environmental elements.

SUMMARY OF THE INVENTION

These and other objects, features and technical advantages are achieved by a system and method which employs a rotatable latch mechanism which is provided integrally with a hatch door, panel, or other surface of an assembly to be retained. A preferred embodiment of the present invention utilizes a hatch door configured to include a latch cup in which a portion of a latch mechanism, referred to herein as a latch actuator, is received. According to the preferred embodiment, the latch actuator includes a portion that extends through the latch cup to the underside of the hatch door to thereby engage a latch bolt portion of the latch mechanism. Of course, alternative embodiments might provide a portion of a latch bolt that extends through the latch cup to engage a latch actuator or a separate shaft portion to extend through the cup and engage both a latch actuator and a latch bolt.

The preferred embodiment latch actuator provides a surface through which a user may apply force to operate the latch mechanism. Through rotational manipulation of the latch actuator, the latch bolt of the preferred embodiment may be rotated to engage/disengage a hatch frame or panel into which the hatch is disposed. Preferably, the latch mechanism of the present invention is provided with stops to limit rotational movement of the latch actuator and latch bolt. For example, a preferred embodiment provides a stop at 0°, i.e., latch engaged, and a stop at 90°, i.e., latch disengaged. Through reference to the latch actuator, a user may easily determine the status of the latch.

The shape of the preferred embodiment latch cup and the shape of the preferred embodiment latch actuator substantially correspond to thereby provide a nesting arrangement when assembled, thus minimizing openings through which water infiltration may occur. Additionally, the preferred embodiment latch actuator is sized and shaped so as to provide substantially flush surfaces with the hatch door when disposed in the latch cup. Moreover, the preferred embodiment latch cup and latch actuator are shaped so as to cooperatively provide a surface between which a seal may be disposed. Alternative embodiments of the present invention provide multiple such surfaces to thereby provide a plurality of seals and, thus, improve the water impermeability of the latch mechanism.

According to a preferred embodiment, the nesting of the latch actuator within the latch cup is with relaxed force when the latch is disengaged and substantially throughout movement of the latch bolt to the engaged position. Accordingly, the life of seals utilized by the preferred embodiment latch mechanism may be prolonged by reduced frictional wear and/or reduced degradation due to the presence of abrasive particles.

A preferred embodiment of the latch bolt of the present invention provides a tapered, or ramped, surface which engages a frame or panel to maintain the hatch in a closed position. Accordingly, the latch mechanism may be operated without undue force, and the relaxed force of the nesting of the latch actuator in the latch cup may be maintained, throughout much of latch movement range. However, as the tapered surface of the latch bolt is moved to its fully engaged position, the forces holding the hatch door against the frame or panel into which it is disposed increase, thereby providing an affirmative or "dog down" latching force as well as an aggressive hatch seal.

According to a preferred embodiment of the present invention, the hatch door and/or latch cup disposed thereon includes surfaces, such as may be provided by annular tabs provided about the periphery of the latch bolt, against which the latch bolt transfers closing pressure from a hatch frame, or other engaged surface, to the hatch door. Accordingly, the interface between the latch bolt and latch actuator is substantially relieved of the aforementioned affirmative latching force which is instead transferred directly from the latch bolt to the hatch door through these surfaces. However, preferred embodiments of the invention provide for a portion of the closing pressure transferred from the latch bolt, such as may be controlled by a gap or other attribute of the aforementioned annular tabs, to provide a sealing pressure to a component or components of the latch assembly. Preferred embodiments of the present invention are adapted to apply the aforementioned sealing pressure substantially equally across a sealing surface. Accordingly, the life of seals may be prolonged by the equal application of force thereon.

A preferred embodiment of the present invention provides a locking mechanism to discourage unauthorized access to an area enclosed by the hatch. Preferably the locking mechanism is provided on the latch actuator to discourage its unauthorized manipulation. According to a preferred embodiment, the locking mechanism is provided in such a way as to engage a surface of the latch cup to thereby prevent rotation of the latch actuator disposed therein. The preferred embodiment of the locking mechanism is disposed so as to be on the weather side of a seal disposed between surfaces of the latch actuator and the latch cup. Accordingly, inclusion of such a locking mechanism in this embodiment of the latch does not introduce water infiltration problems.

Preferred embodiments of the above described latch mechanism components are made of plastics, resins, and/or composite materials to thereby withstand environmental elements, such as solar rays, moisture (such as corrosive salt water spray), and/or movement, such as that associated with a marine vessel in movement over water.

Accordingly, a technical advantage of the present invention is that the latch system of the preferred embodiment is adapted to provide secure closing of a hatch door and to inhibit moisture from entering the enclosed area.

A further technical advantage of the present invention is provided in that the latch system provides positive indication to a user of its engaged or disengaged status.

A still further technical advantage of the present invention is that the latch system provides a substantially flush surface without requiring an operator to manipulate portions thereof to achieve such a flush surface.

A yet further technical advantage of the present invention is that the latch system is resist to deterioration due to environmental elements.

Another technical advantage of the present invention is provided in employing a latch locking mechanism which is resistant to degradation, such as through exposure to environmental elements.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
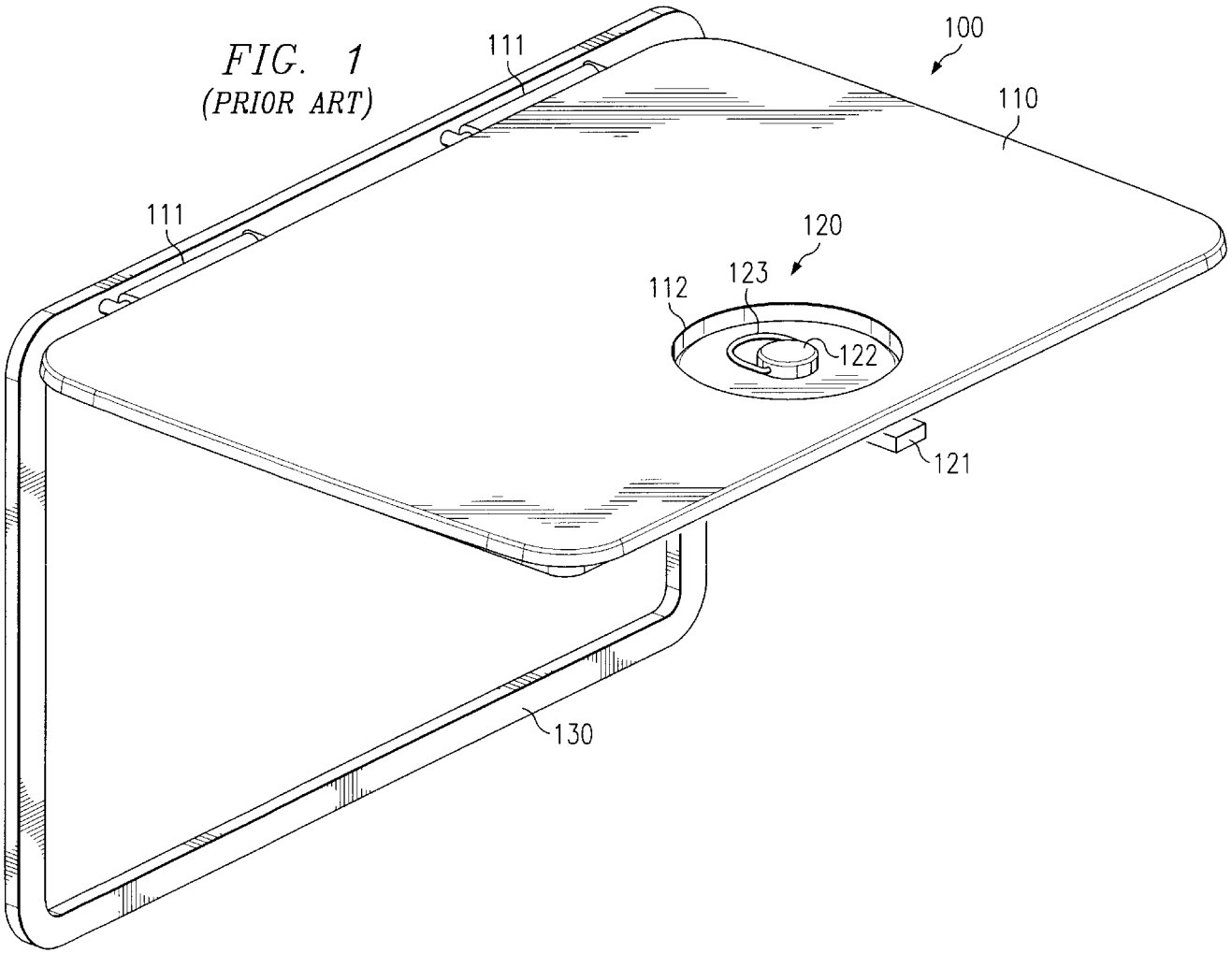
FIG. 1 (PRIOR ART)
FIG. 1 shows a typical prior art hatch and latch assembly.
Figure 2:
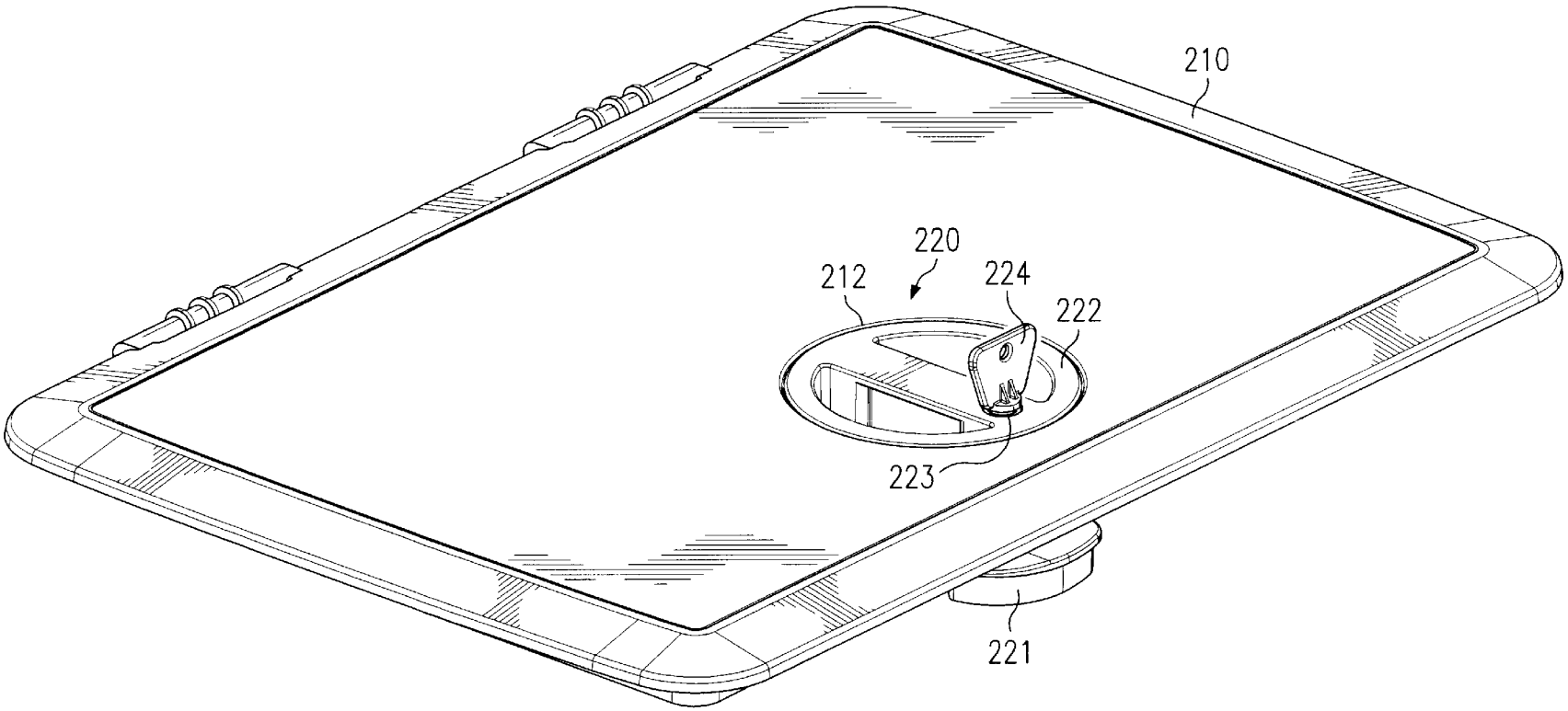
FIG. 2 shows a top view of a hatch door having a preferred embodiment latch of the present invention disposed therein.

Directing attention to FIG. 2, a preferred embodiment latch according to the present invention is shown disposed in a hatch assembly. Specifically, hatch door 210 is shown having disposed therein latch mechanism 220 of the present invention. Latch mechanism 220 of the illustrated embodiment includes latch actuator 222, disposed on a front side of hatch door 210, interfaced with latch bolt 221, disposed on a back side of hatch door 210. Hatch door 210 is preferably adapted to receive latch mechanism 220 and, therefore, in the preferred embodiment provides latch cup 212 into which latch actuator 222 is disposed. In the preferred embodiment the surface of the latch actuator does not protrude above the surface of the hatch door into which it is disposed.

Latch mechanism 220 of FIG. 2 includes an optional locking mechanism to discourage unauthorized operation of the latch. Accordingly, key 224 is shown in lock 223 in the preferred embodiment of FIG. 2. It should be appreciated that, upon the removal of key 224, latch mechanism 220 includes no portions which extend beyond the front side of hatch door 210 and, therefore, presents substantially flush surfaces with respect to hatch door 210. Of course, a locking mechanism may be omitted in a latch of the present invention, if desired.

Figure 3:
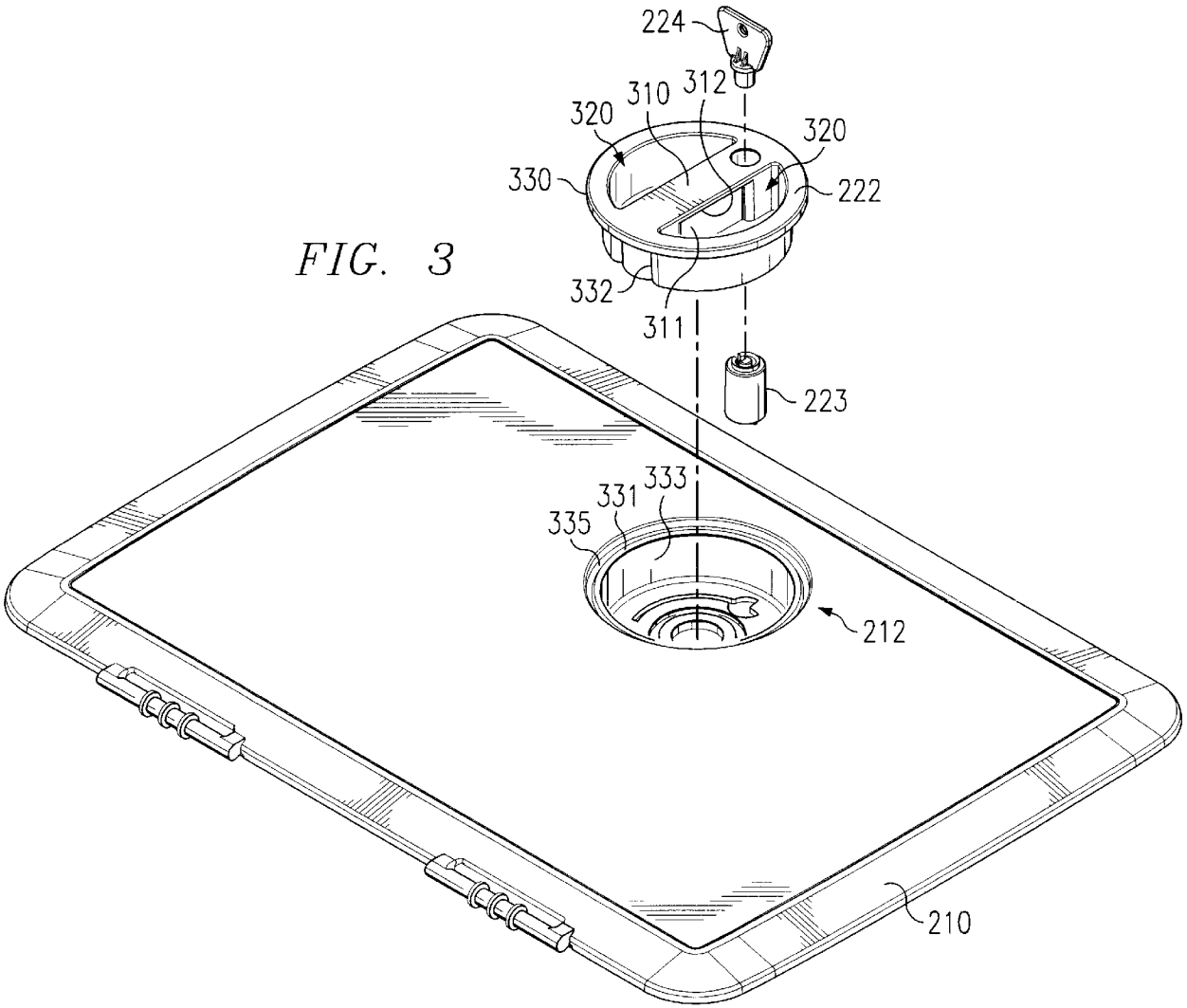
FIG. 3 shows an exploded view of the preferred embodiment latch of FIG. 2.

Directing attention to FIG. 3, latch mechanism 220 of the preferred embodiment is shown in an exploded view wherein latch actuator 222 is removed from latch cup 212. As shown in FIG. 3, the preferred embodiment latch actuator 222 includes handle 310, defined by cavities 320, disposed to provide a flush surface latch actuator 222. Handle 310 is adapted to accept latch manipulation forces from an operator to thereby allow actuation of latch mechanism 220 between an engaged and a disengaged position. Accordingly, the preferred embodiment of handle 310 illustrated includes actuation force surface 311 and a corresponding actuation force surface (not shown) disposed on the opposite side of handle 310. Handle 310 is also preferably adapted to accept hatch manipulation forces from an operator to thereby allow the manipulation of hatch door 210 between an open and a closed position. Accordingly, the preferred embodiment of handle 310 illustrated includes grip surface 312 and a corresponding grip surface (not shown) disposed on the opposite side of handle 310.

It should be appreciated that cavities 320 provide a space in which an operator's fingers may be disposed on either side of handle 310 to thereby apply forces to the actuation force surfaces thereof and, thus, rotate latch mechanism 220 between an engaged position and a disengaged position. Additionally, the grip surfaces of handle 310, such as the preferred embodiment grip surface 310, provide a handle surface disruption suitable to facilitate the user's fingers gripping the latch mechanism in order to apply an opening force to hatch door 210, even when wet due to being utilized in a boat or other moist environment.

It should be appreciated that the preferred embodiment latch actuator 222 is shaped to substantially correspond to the shape of latch cup 212. For example, referring still to FIG. 3, latch actuator 222 includes rim 330 corresponding to ledge 331 of latch cup 212. Similarly, latch actuator includes sidewall 332 substantially corresponding to sidewall 333 of the latch cup 212. Accordingly, the preferred embodiment not only provides relatively small areas between the components of the assembled latch mechanism to discourage the infiltration of matter, such as dirt and/or water, but also provides orthogonalities in the interface to further discourage infiltration of matter.

Figure 4:
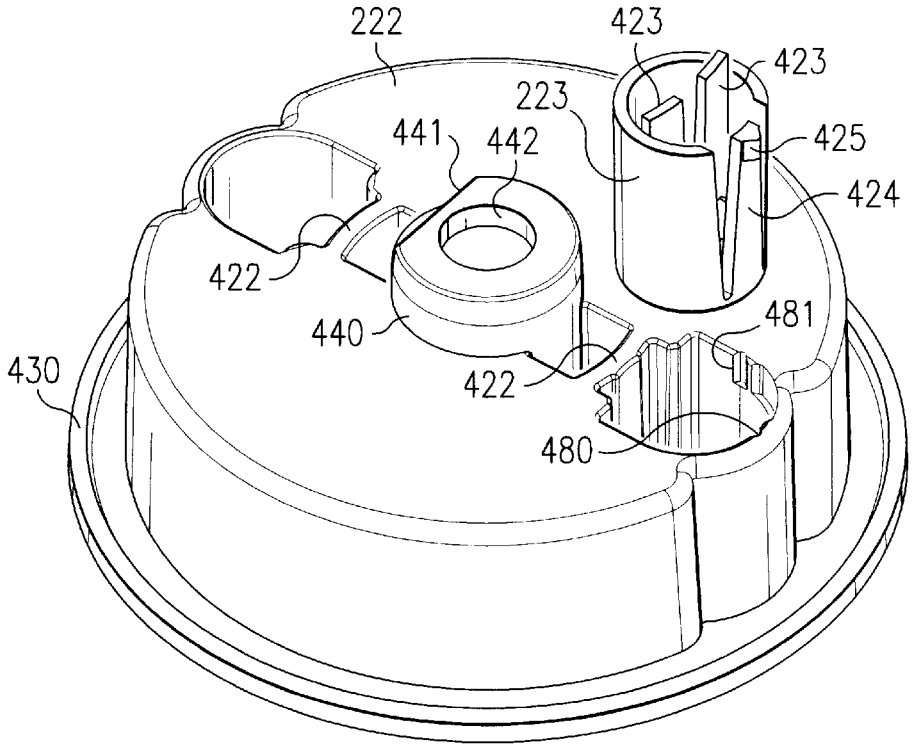
FIG. 4 shows a bottom view of a preferred embodiment latch actuator and lock of a latch of the present invention.

Directing attention to FIG. 4, in addition to the aforementioned rim, a most preferred embodiment of the present invention provides lip 430 to provide additional orthogonalities in the interface of latch actuator 220 and latch cup 212. Accordingly, a type of dam is provided at the outermost edge of latch actuator 220 to discourage the infiltration of matter. Moreover, the most preferred embodiment of latch cup 212 includes groove 335 (referring again to FIG. 3) disposed on ledge 331 in juxtaposition with lip 430 to cooperate therewith to further discourage the infiltration of matter.

Figure 5:
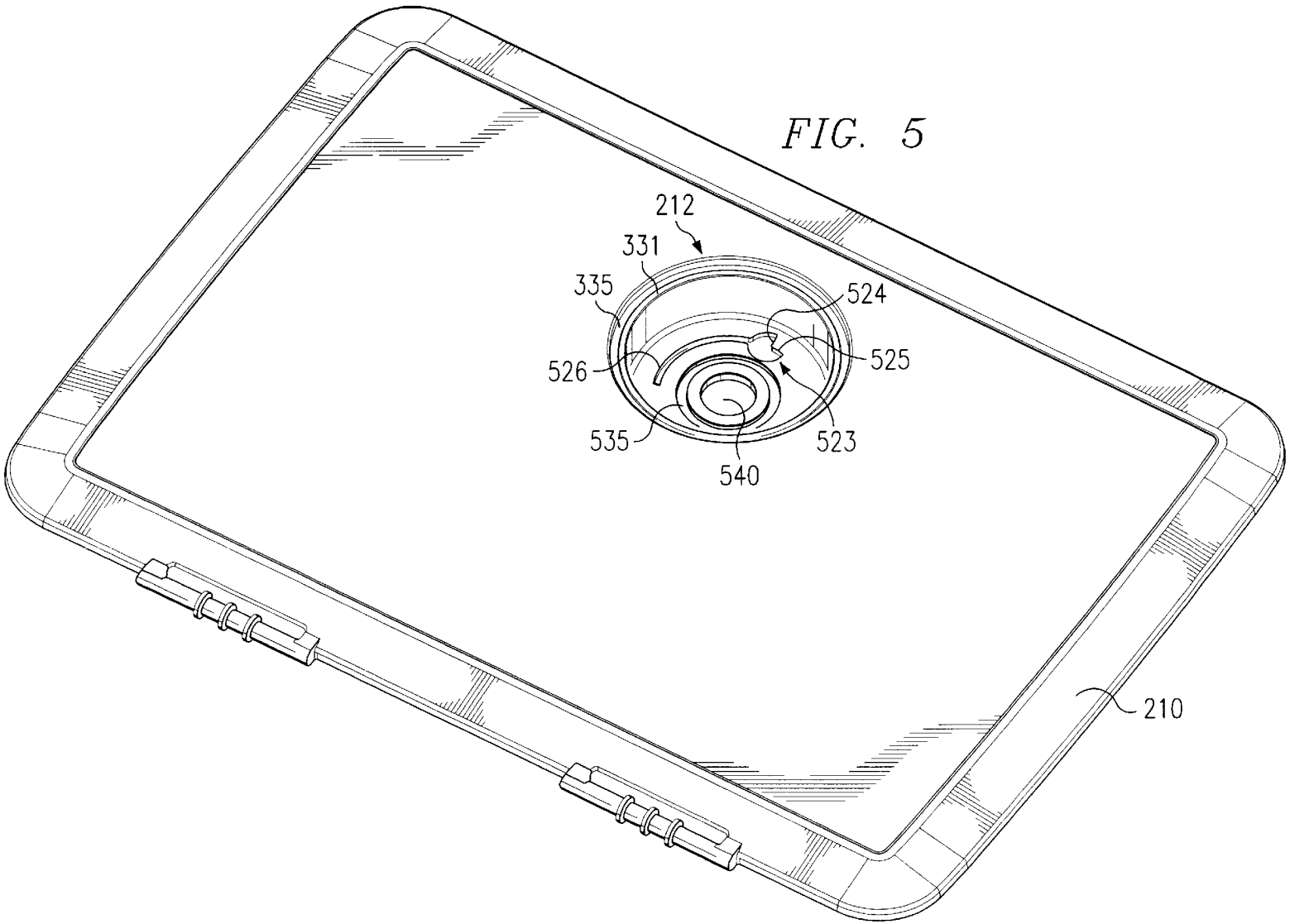
FIG. 5 shows a top view of a preferred embodiment latch cup of a latch of the present invention.

According to preferred embodiments of the present invention, infiltration of matter, such as dirt and/or water, is additionally or alternatively discouraged through the use of sealing rings disposed between flat or substantially flat surfaces of latch mechanism 220. For example, directing attention to FIG. 5, latch cup 212 of the illustrated embodiment preferably includes groove 535 into which a sealing ring (see seal 356 of FIG. 3) of the present invention may be disposed. It should be appreciated that groove 535, and thus a corresponding sealing ring, is disposed on a flat top surface of latch cup 212 corresponding to a flat bottom surface of latch actuator 222. Accordingly, a sealing ring comprised of a resilient material, such as rubber, a foamed polymeric substance, or the like, may be provided to engage both the latch cup and latch actuator at a regular surface and, thereby, provide a reliable seal against water and other infiltration.

It should be appreciated that, in order to reduce the amount of material utilized in the construction of latch mechanism 220 and/or to reduce the weight of latch mechanism 220, the underside of handle 310 is provided with cavities or voids (shown in FIG. 4). Accordingly, the preferred embodiment provides bridges 422 to thereby provide a smooth surface bridging these voids for continuous engagement of the preferred embodiment sealing ring. Of course, alternative embodiments may omit the bridges, such as where sealing rings are disposed in a different position, and/or the voids, such as where handle 310 is configured differently or where the amount of material utilized in constructing latch mechanism 220 is determined to be unimportant.

Alternative embodiments of the present invention may include adaptation of the bottom surface of latch actuator 222 to include a corresponding groove into which the sealing ring may also be disposed in order to provide further discouragement of infiltration of matter. Of course, rather than providing a groove for the sealing ring in the latch cup or in the latch cup and latch actuator, alternative embodiments of the present invention may provide a groove for the sealing ring solely in the latch actuator, if desired. Moreover, where less stringent sealing requirements are present, no groove may be provided in either the latch cup or the latch actuator for housing a sealing ring. For example, a standard O ring type seal may be utilized, such as around shaft 440 (FIG. 4) of latch actuator 222 to cooperate with an edge surface of shaft via 540 (FIG. 5) of latch cup 212 and, thereby, provide at least a minimal level of sealing.

An alternative embodiment of the present invention provides multiple levels of seals in order to further discourage infiltration. For example, the aforementioned sealing ring, disposed in groove 535, and O ring, disposed around shaft 440, may both be utilized to provide increased sealing of latch mechanism 220. Additionally or alternatively, multiple concentric sealing rings may be employed, such as through the provision of concentric grooves on the top surface of latch cup 212. One alternative embodiment of the present invention provides a sealing ring in groove 335 to provide a seal at an outermost portion of latch mechanism 220.

As will be discussed in further detail herein below, according to a preferred embodiment, the nesting of latch actuator 222 within latch cup 212 is with a slightly relaxed force substantially throughout manipulation of latch mechanism 220 between a disengaged position to a fully engaged position. Accordingly, although providing sufficient force between latch cup 212 and latch actuator 222 to maintain an adequate or desired seal at all positions, the life of seals utilized by the preferred embodiment latch mechanism may be prolonged by reduced frictional wear, equal application of force, and/or reduced degradation due to the presence of abrasive particles caused by unnecessary compression forces throughout operational movement of the latch mechanism.

Figure 6:
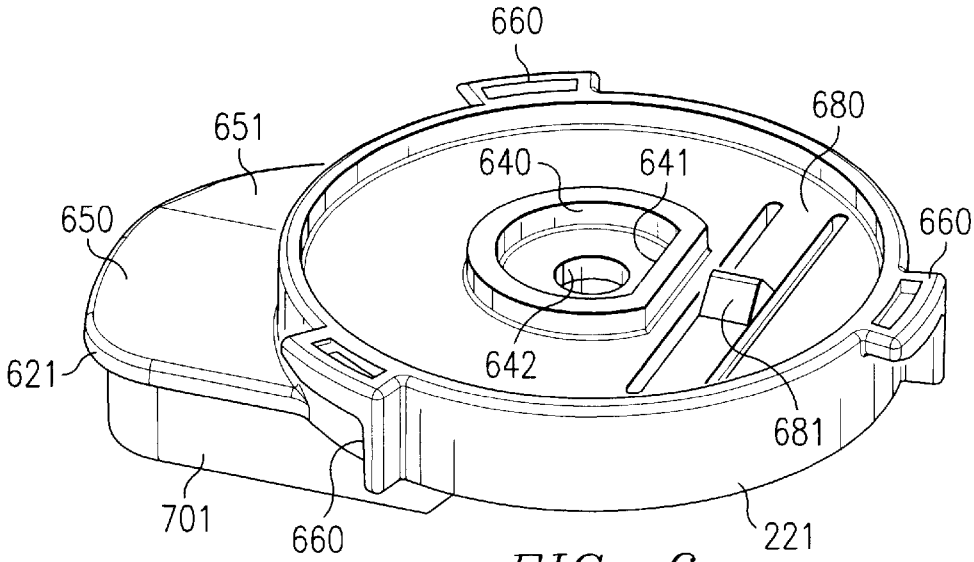
FIG. 6 shows a top view of a preferred embodiment latch bolt of a latch of the present invention.

Directing attention to FIG. 6, a preferred embodiment of latch bolt 221 are shown. In order to receive and engage shaft 440 of latch actuator 222 extended through shaft via 540, latch bolt 221 preferably includes receiver 640 disposed thereon. Preferably latch bolt 221 and latch actuator 222 are adapted to be securely attached to one another. Accordingly, the preferred embodiment illustrated includes fastener receivers 442 and 642 to accept a fastener, such as a screw, a bolt, a rivet, and/or the like. Although substantially permanent mating of latch bolt 221 and latch actuator 222 may be accomplished through the use of irreversible screws, epoxies or glues, ultrasonic welding, and/or the like, a preferred embodiment of the present invention utilizes a removable fastener to facilitate repair and/or alteration of the latch mechanism components. For example, it may be desired to replace a lock cylinder, discussed in further detail herein below, with one having a key configuration common to other hatches utilized together. The use of a removable fastener allows the relatively simple disassembly of latch mechanism 220 for the replacement of the locking component.

The preferred embodiment of receiver 640 includes adaptation to accept the transfer of actuation forces from latch actuator 222 to thereby prevent the slippage or spinning of latch bolt 221 on shaft 440. Accordingly, the preferred embodiment illustrated includes D keyed surface 641 corresponding to D key notch 441 on shaft 440. It should be appreciated that the use of such an adaptation to accept the transfer of actuation forces allows reliable operation of the latch mechanism even in cases where the aforementioned fastener does not provide a tight friction fit.

Figure 7:
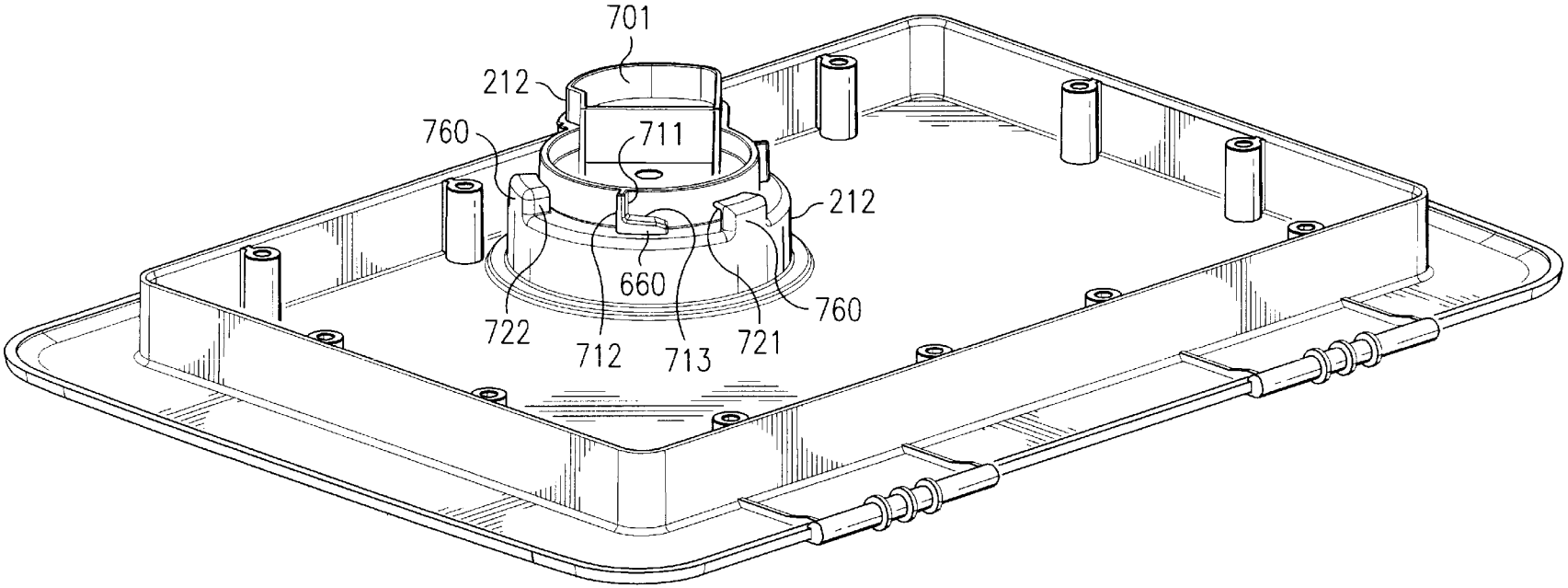
FIG. 7 shows a bottom view of the hatch door of FIG. 2 wherein the bolt is illustrated in a partially engaged position.

Latch bolt 221 of the preferred embodiment includes stops 660 adapted to limit the rotational movement of latch mechanism 220 and increased strength when a force is applied to bearing surface 713. Directing attention to FIG. 7, the bottom of the preferred embodiment of latch cup 212 is shown to include tabs 760 corresponding to stops 660 of the preferred embodiment of latch bolt 221. As shown in FIG. 7, wherein latch mechanism 220 is shown in a position between fully engaged and fully disengaged, the preferred embodiment stops 660 are illustrated to include engagement stop surface 711 and disengagement stop surface 712. Accordingly, when latch bolt 221 is manipulated into a fully disengaged position, disengagement stop surface 712 abuts corresponding disengagement stop surface 722 of tab 760. Similarly, when latch bolt 221 is manipulated into a fully engaged position, engagement stop surface 711 abuts corresponding engagement stop surface 721 of tab 760. Directing attention to FIG. 8, wherein latch mechanism 220 is shown in a fully engaged position, the engagement stop surface of the latch actuator stops are shown engaged with the engagement stop surface of the latch cup tabs.

It should be appreciated that the relative positioning of engagement stop surface 721 and disengagement stop surface 722 help define the limits of rotational movement of latch mechanism 220 according to this preferred embodiment. According to a most preferred embodiment, the stops of the present invention are disposed so as to provide substantially 90° of latch mechanism rotational movement. Accordingly, a status of latch mechanism 220 may easily be confirmed through visible indicators. For example, a preferred embodiment of the present invention provides engagement stops such that handle 310 is in a perpendicular orientation with respect to the latched edge of hatch door 210 while the disengagement stops provide a parallel orientation of handle 310 with respect to the latched edge of hatch door 210.

Although the illustrated embodiment shows a plurality of stops 660 and tabs 760, it should be appreciated that any number of either or both may be utilized according to the present invention, depending upon the amount of rotational force to be withstood, the amount of rotational movement desired, and which stop and/or tab surfaces are to be relied upon to limit rotation. However, the preferred embodiment of the present invention utilizes a plurality of such stops and tabs as these components are preferably adapted to provide functionality beyond the limiting of rotational movement heretofore described.

Figure 8:
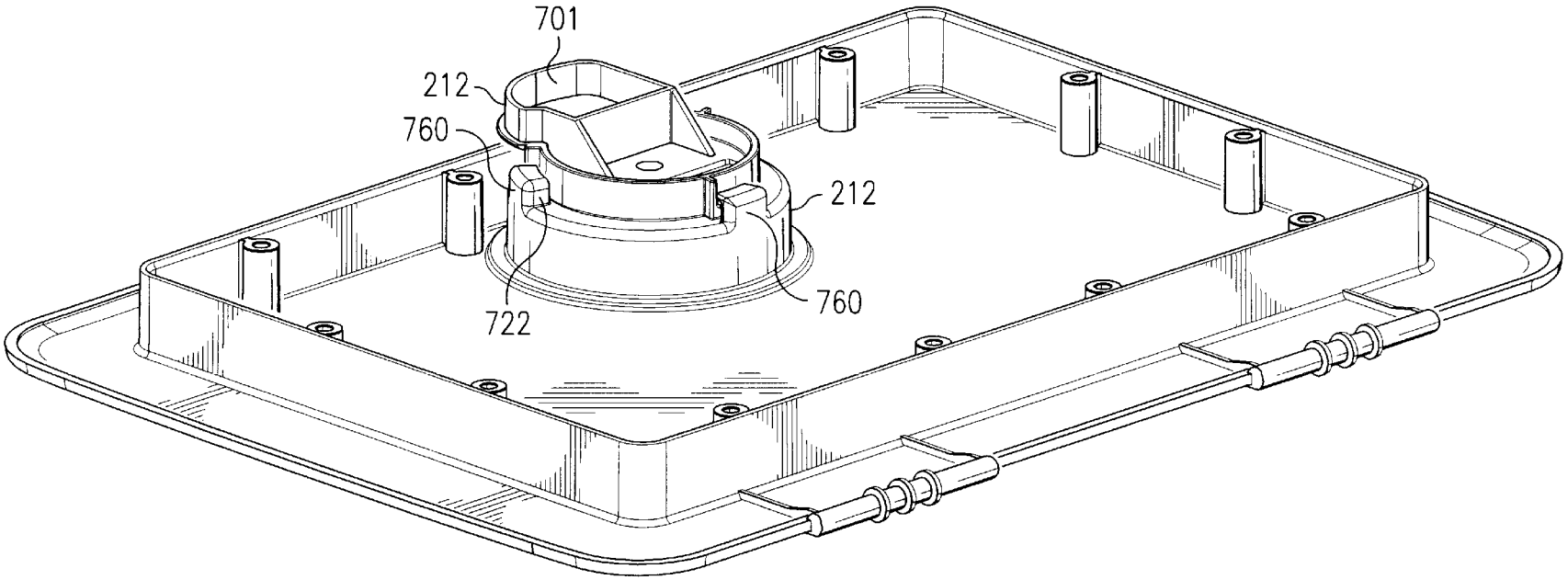
FIG. 8 shows the bottom view of FIG. 7 wherein the bolt is illustrated in a fully engaged position.

Referring again to FIG. 7, stops 660 preferably include bearing surface 713, which in the most preferred embodiment is tapered or ramped, adapted to engage an undersurface of tabs 760 (illustrated in FIG. 8). Accordingly, when latch bolt 221 engages a frame or panel in which hatch door 210 is disposed, forces retaining hatch door 210 in the closed position may be transferred through bearing surface 713 of latch bolt 221 to tabs 760 of latch cup 212 and, thereby, to hatch door 210. Such a preferred embodiment relieves latch actuator 222 of all or substantially all the forces retaining hatch door 210 in the closed position, i.e., little or none of the holding force is transferred from latch bolt 221 to latch actuator 222 through the fastener there between. Because stops 660 and tabs 760 of the preferred embodiment bear these forces, the preferred embodiment includes a plurality of sets of such components to thereby distribute these loads such that they may be easily accommodated by the preferred plastic or resin embodiments of the present invention. Moreover, the preferred embodiment tapered bearing surfaces cooperate with a taper of the latch bolt surface to provide an aggressive, preferably equal, latching force.

Directing attention again to FIG. 6, it should be appreciated that the preferred embodiment of bolt member 621 of latch bolt 221 includes surface 650 to engage a frame or panel in which hatch door 210 is disposed, to thereby prevent opening of hatch door 210 without the manipulation of latch mechanism 220. In order to ensure a tight fit of hatch door 210 against the frame or panel, or a sealing element disposed there between, the preferred embodiment bolt member 621 includes tapered or ramped surface portion 651. It should be appreciated that the forces exerted as tapered surface portion 651 is traversed during operational manipulation of latch mechanism 220 tend to move bearing surface 713 toward the under surface of tab 760 to thereby tighten this interface. Similarly, the forces exerted as tapered surface portion 651 is traversed during operational manipulation of latch mechanism 220 tend to move latch actuator 222, coupled to latch bolt 221 through shaft 440 and receiver 640, deeper into latch cup 212 and, thereby, provides additional compression forces upon seals disposed therein, such as a sealing ring disposed in groove 535.

Accordingly, latch mechanism 220 may be operated without undue force, and the relaxed force of the nesting of latch cup 221 and latch actuator 222 may be maintained, throughout much of latch movement range. However, as the tapered surface of the latch bolt is moved to its fully engaged position, the forces holding the hatch door against the frame or panel into which it is disposed increase, thereby providing an affirmative latching force as well as an aggressive hatch seal with respect to both a hatch door seal and a latch mechanism seal.

Because bolt member 621 of latch bolt 221 provides forces to prevent hatch door 210 from opening when latch mechanism is engaged, the preferred embodiment provides a bolt member adapted to withstand expected sheer forces. Accordingly, the preferred embodiment includes reinforcing structure 701 to provide added sheer strength to bolt member 621. Of course, alternative embodiments of the present invention may omit reinforcing structure with respect the bolt member, if desired. For example, hardening fillers, impact modifiers, and/or the like may be provided in a plastic material used to construct bolt member 621 and/or latch bolt 221 to thereby provide a desired level of durability of this element of latch mechanism 220. Additionally or alternatively, bolt member 621 itself may be modified to provide increased strength, such as through providing a thicker profile. However, the preferred embodiment provides reinforcing structure as opposed to providing a thicker bolt member so as to provide increased strength without requiring substantially more material and/or substantially added weight.

Figure 9:
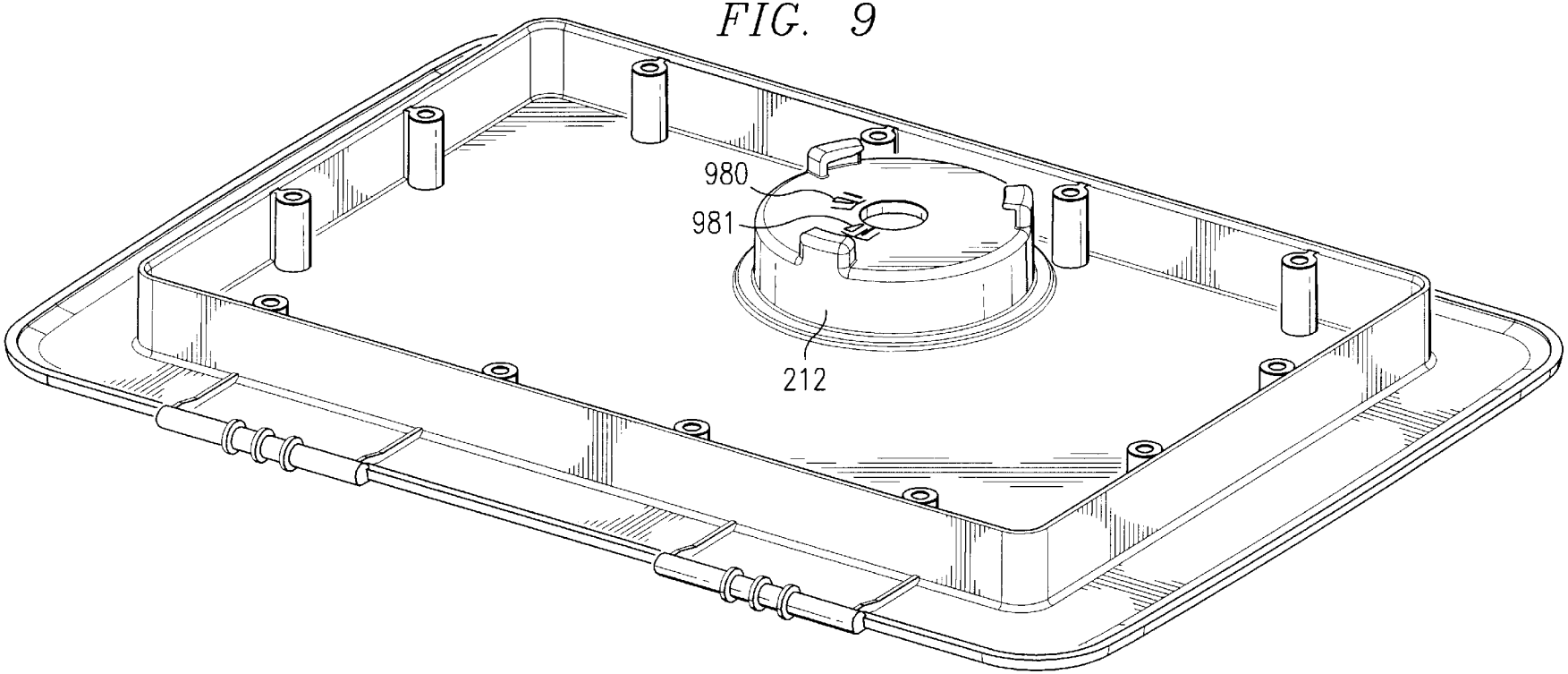
FIG. 9 shows a bottom view of a preferred embodiment latch cup of a latch of the present invention.

The preferred embodiment of latch mechanism 220 is adapted to provide affirmative feedback of positioning in a fully engaged and/or fully disengaged position. For example, directing attention again to FIG. 6, spring 680 having nib 681 disposed thereon provides affirmative feedback of particular positions of latch mechanism 220 by engaging detents provided on the bottom surface of latch cup 212. Directing attention to FIG. 9, detents 980 and 981 are shown corresponding to a fully disengaged and fully engaged position of latch mechanism 220 respectively. Accordingly, when latch bolt 221 is rotated to a corresponding position, an affirmative "click" is felt to confirm the completion of positioning latch mechanism 220.

Additionally or alternatively, latch mechanism 220 is adapted to restrain movement of latch bolt 221 when no actuation force is present. Accordingly, the preferred embodiment of latch mechanism 220 relies upon spring 680, nib 681, and detents 980 and 981 to restrict rotational movement of latch bolt 221 when a user is not applying operational forces to handle 310.

According to a preferred embodiment of latch mechanism 220, spring 680, nib 681, and detents 980 and 981 are adapted so as to allow spring 680 to fully relax when nib 681 engages either of detent 980 or detent 981. It is preferred to allow the spring to fully relax in the preferred embodiment wherein plastics or other resins are utilized because when plastics are placed under load for an extended period of time, they can deform or creep so that they do not perform their function. Therefore, the preferred embodiment will provide for increased functional life of the mechanism.

In alternative embodiments, the relaxation of the spring may be provided at positions in addition to or in the alternative to the fully engaged and fully disengaged positions. For example, detents 980 and 981 may be defined by tapered or ramped surfaces leading up to the detent. Accordingly, nib 681 may engage the under surface of latch cup 212 substantially only at positions in the rotational movement just prior to engaging one of the detents. In such an embodiment, spring 680 may be maintained in a fully relaxed state throughout most of the radial movement between engaged and disengaged as well as at the fully engaged and fully disengaged positions.

Although a preferred embodiment has been described with reference to a spring being provided upon latch bolt 221 and corresponding structure being provided on latch cup 212, it should be appreciated that there is no such limitation of the present invention. For example, a spring and nib may be disposed on latch cup 212 with corresponding detents disposed on latch bolt 221. Additionally or alternatively a spring and corresponding detents may be disposed on either of latch cup 212 and latch actuator 222.

It should be appreciated that, although the preferred embodiment provides detents only at a fully engaged and a fully disengaged position, the present invention is not so limited. For example, detents may be provided throughout the rotational movement of latch mechanism 220 to provide a "ratchet" type operational movement. Moreover, although the preferred embodiment has been described with reference to a spring nib and detent mechanism, it should be appreciated that the present invention may utilize any number of techniques to provide affirmative feedback of positioning and/or to restrain movement of the latch bolt. For example, a rack and pinion type mechanism might be utilized.

Figure 10:
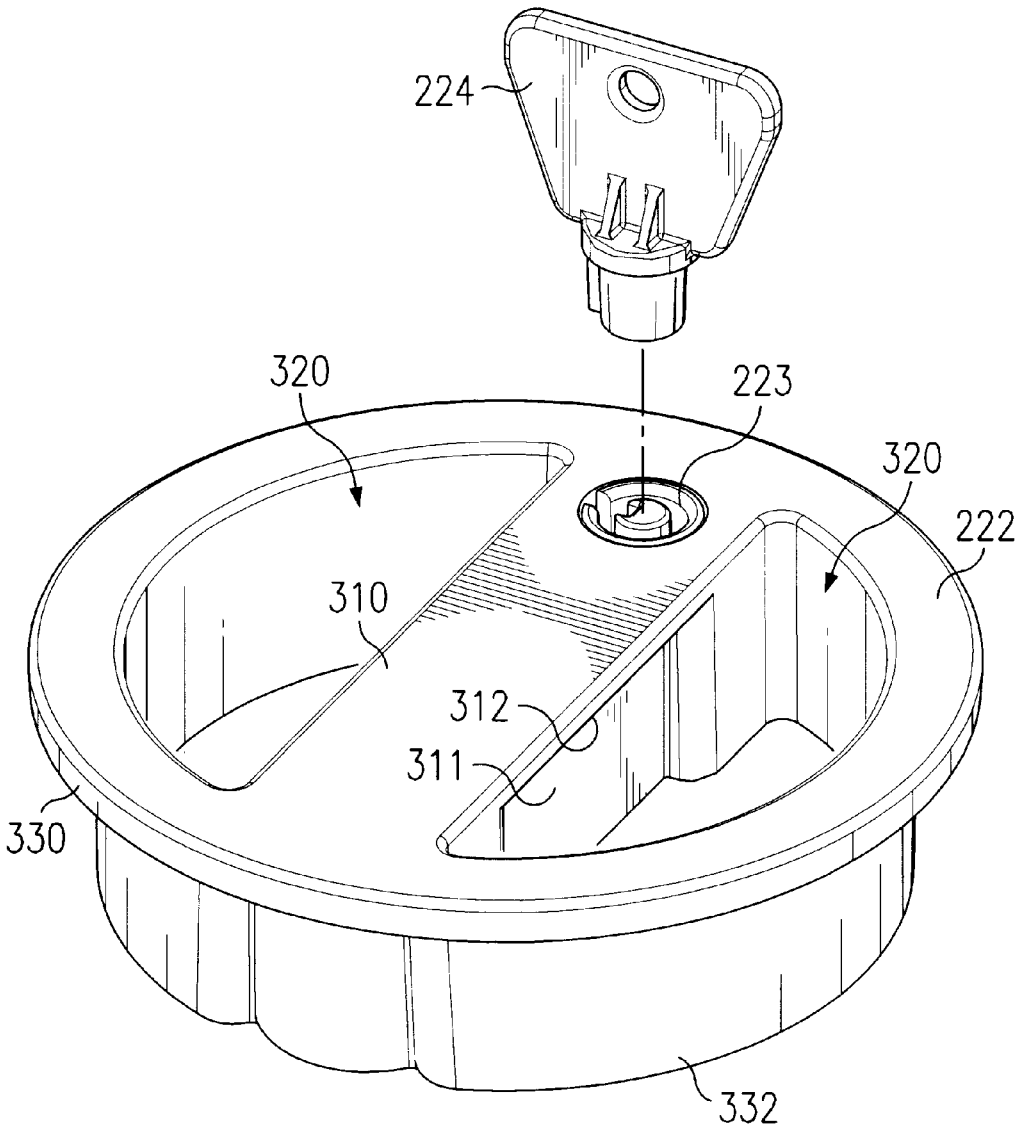
FIG. 10 shows an exploded view of a preferred embodiment latch actuator and key of the present invention.

Directing attention again to FIG. 2, it can be seen that the preferred embodiment of latch mechanism 220 includes a lock to discourage unauthorized operation of latch mechanism 220. A preferred embodiment of lock 223 is shown in the exploded view of FIG. 4. Specifically, the preferred embodiment of lock 223 includes a lock cylinder which is accepted into latch actuator 222 to expose a key hole there through (see FIG. 10). According to a preferred embodiment, the lock cylinder of lock 223 is incarcerated in latch mechanism 220 by latch actuator 222 (which preferably includes an opening sufficient to expose the hey hole but insufficient to allow the lock cylinder to be extracted) and latch cup 212. Accordingly, when latch mechanism is assembled, lock 223 is securely contained within the mechanism.

The preferred embodiment of lock 223 includes bolts 423 which are controlled by manipulation of lock 223 to prevent or allow operational movement of latch mechanism 220. Preferably, bolts 423 engage a corresponding structure of latch cup 212 when lock 223 is engaged and allow free movement of latch mechanism 220 when lock 223 is disengaged. Directing attention again to FIG. 5, preferred embodiment structure of latch cup 212 corresponding to lock 223 is shown as receiver 523. Receiver 523 of the preferred embodiment is adapted to receive bolts 423 and to allow their free travel through groove 526, and thus the free travel of latch mechanism 220, when lock 223 is disengaged.

Specifically, when a proper key 224 is inserted into the key hole of lock 223 and rotated counter-clockwise (as viewed from above latch mechanism 220), one of bolts 423 will encounter disengagement stop surface 525 and be prevented from further rotation. Accordingly, bolts 423 will be aligned with groove 526 and, therefore, operational manipulation of latch mechanism 220 will be allowed. However, when the proper key 224 is inserted into the hey hole of lock 223 and rotated clockwise, one of bolts 423 will encounter engagement stop surface 524 and be prevented from further rotation. Accordingly, bolts 423 will be orthogonal to groove 526 and, therefore, operational manipulation of latch mechanism 220 will be prevented.

The preferred embodiment of lock 223 is adapted to provide affirmative feedback of positioning in a fully engaged and/or fully disengaged position. For example, directing attention again to FIG. 4, spring 424 having nib 425 disposed thereon provides affirmative feedback of particular positions of lock 223 by engaging detents 480 and 481 provided on an inside surface of latch actuator 222. Preferably detents 480 and 481 correspond to a fully disengaged and fully engaged position of lock 223 respectively. Accordingly, when lock 223 is rotated to a corresponding position, an affirmative "click" is felt to confirm the completion of positioning lock 223.

Additionally or alternatively, lock 223 is adapted to restrain movement of the lock when no actuation force is present. Accordingly, the preferred embodiment of lock 223 relies upon spring 424, nib 425, and detents 480 and 481 to restrict rotational movement of lock 223 when a user is not applying operational forces, such as via key 224.

According to a preferred embodiment of lock 223, spring 424, nib 425, and detents 480 and 481 are adapted so as to allow spring 424 to fully relax when nib 425 engages either of detent 480 or detent 481. As described above with respect to spring 680, it is preferred to allow the spring to fully relax in the preferred embodiment wherein plastics or other resins are utilized because when plastics are placed under load for an extended period of time, they can deform or creep so that they do not perform their function.

In alternative embodiments, the relaxation of the spring may be provided at positions in addition to or in the alternative to the fully engaged and fully disengaged positions. For example, detents 480 and 481 may be defined by tapered or ramped surfaces leading up to the detent. Accordingly, nib 425 may engage the inside surface of latch actuator 222 substantially only at positions in the rotational movement just prior to engaging one of the detents. In such an embodiment, spring 424 may be maintained in a fully relaxed state throughout most of the movement between engaged and disengaged as well as at the fully engaged and fully disengaged positions.

Although a preferred embodiment has been described with reference to a spring being provided upon lock 223 and corresponding structure being provided on latch actuator 222, it should be appreciated that there is no such limitation of the present invention. For example, a spring and nib may be disposed on latch actuator 222 with corresponding detents disposed on lock 223.

It should be appreciated that, although the preferred embodiment provides detents only at a fully engaged and a fully disengaged position, the present invention is not so limited. For example, detents may be provided throughout the rotational movement of lock 223 to provide a "ratchet" type operational movement.

Moreover, it should be appreciated that the present invention is not limited to the specific embodiment of lock 223 illustrated. A lock utilized according to the present invention may employ any suitable means for controlling operational movement of the latch mechanism. For example, rather than the two bolts shown in the preferred embodiment, a single bolt may be employed. Similarly, a more traditional lock mechanism, such as includes key tumblers and the like, may be utilized according to the present invention. However, it should be appreciated that the preferred embodiment provides a lock mechanism which adds only a single component to the latch mechanism (plus a key retained by the operator). Accordingly, the preferred embodiment lock is simple and inexpensive to implement.

Moreover, the preferred embodiment lock may be constructed entirely of plastic or other resins, thereby providing a lock which is substantially unaffected by corrosive elements. It should be appreciated that the preferred embodiment lock, constructed of plastic materials, is intended to be a tamper resistant type lock, rather than a complete barrier to entry. Such a tamper resistant type lock is often desirable to discourage unauthorized access in a public or semi-public place, such as at a busy marina where a boat including hatch door 210 is tied while the owner is temporarily absent to obtain provisions. Moreover, as the preferred embodiment hatch door and latch mechanism are also embodied in plastic materials, an individual desiring access to the space enclosed by hatch door 210 could obtain access irrespective of the ability of the lock to withstand force.

According to the preferred embodiment key 224 provides a hollow cylindrical key shaft having two male ribs thereon, one being on the inside of the hollow shaft and the other being on the outside of the hollow shaft. Accordingly, these two ribs may be placed with different relative positions on the key shaft to provide a plurality of unique key combinations, such as on the order of eight to ten unique key combinations. Although such a key system is insufficient to provide a differently keyed lock to all who may implement the present invention, it is expected to be sufficient to provide the tamper resistant level of security described above with respect to the preferred embodiment. Of course more elaborate keying techniques may be utilized according to the present invention to provide more unique key combinations. For example, various shaped key holes and key shafts may be utilized, such as square, triangular, stared, and the like, with or without the addition of the aforementioned ribs.

The lock of the present invention need not be disposed as shown and/or engage the latch actuator and latch cup of the preferred embodiment. For example, the lock may be provided in a portion of the latch cup to engage a portion of the latch bolt, if desired.

As discussed above, preferred embodiments of the present invention utilize plastics or other resins to provide strong components able to endure environmental elements. For example, according to a preferred embodiment hatch door 210 is comprised of a thermo-formed polymeric material preferably having a filler to provide hardness included therein, such as 30% glass-filled polypropylene. It should be appreciated that such material is relatively inexpensive as well as strong. However, molding of parts using such a material often does not provide casting resolution to a degree that the detailed components of the preferred embodiment of the present invention, such as the grooves, springs, nibs, detents, key holes, etcetera may be reliably and consistently formed. Moreover, the preferred embodiment of the present invention provides for friction interfacing of various components and, therefore, it is preferred that ones of these components provide a self lubricated surface. Accordingly, the most preferred embodiment of the present invention utilizes plastics adapted to provide resiliency suitable for a biasing interference as well as a surface having lubricant characteristics, such as acetyl, in forming components of the latch mechanism of the present invention. For example, while latch cup 212 may be formed of a same polymeric material as hatch door 210, each of latch bolt 221, latch actuator 222, lock 223, and key 224 may be comprised of acetyl because it is an inherently lubricated material, provides properties suitable for forming the springs of the preferred embodiment, and is exceedingly tough. Moreover, the use of acetyl allows for the injection mold formation of much thinner wall sections than is typically possible with glass-filled polypropylene.

Of course, materials in addition to or in the alternative to those discussed above may be utilized according to the present invention. For example, the latch mechanism or portions thereof may be formed of metals or metal alloys. However, the use of metals is preferably minimized or avoided entirely in preferred embodiment in order to provide a latch mechanism which can withstand continued exposure to corrosive salt water.

It should be appreciated that, although preferred embodiments have been described herein with reference to latch cup being formed integrally with a surface such as latch door 210, there is no such limitation of the present invention. For example, a latch cup of the present invention may be formed separately and interfaced to a particular surface, such as latch door 212, through a suitable opening provided therein.

Although preferred embodiments of the present invention have been discussed with reference to a hatch, it should be appreciated that application of the present invention is not so limited. Accordingly, the latch of the present invention may be applied to any number of situations where movement of an item is to be controlled. For example, a latch of the present invention may be provided on a window, a door, a drawer, or even a stand alone container. Similarly, it should be appreciated that, although discussed herein with reference to use in a marine environment, e.g., a boat, the present invention may be utilized in any number of environments.

Moreover, there is no limitation that the latch mechanism of the present invention be disposed on a movable surface, such as the hatch door of the preferred embodiment. In alternative embodiments the latch mechanism may be disposed on a stationary portion of an assembly, such that the latch bolt engages a movable surface of the assembly.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A latch system comprising:

a latch actuator;

a latch bolt coupled to said latch actuator;

a latch cup having a size and shape substantially corresponding to a shape of said latch actuator to receive said latch actuator within said latch cup in a nesting relationship, wherein said latch cup includes a via to facilitate said coupling of said latch actuator and said latch bolt;

a bearing surface; and a tab, wherein said bearing surface is adapted to engage said tab when said latch bolt is disposed in an engaged position, wherein said bearing surface is disposed on said latch bolt and said tab is disposed on said latch cup.

2. The system of claim 1, wherein said latch actuator does not protrude above an upper surface of said latch cup when nested therein.

3. The system of claim 1, wherein said latch actuator comprises:

a handle portion.

4. The system of claim 3, wherein said handle portion comprises:

an actuation surface and a grip surface.

5. The system of claim 3, further comprising:

a stop, wherein said stop defines freedom of movement of said latch actuator within said latch cup.

6. The system of claim 5, wherein said handle portion cooperates with said stop to provide a visual indication of a status of said latch system.

7. The system of claim 5, wherein said stop includes an engagement stop surface, and a disengagement stop surface, at least one of which engages said tab when said stop defines said freedom of movement of said latch actuator.

8. The system of claim 7, wherein said stop is disposed on said latch bolt.

9. The system of claim 7, further comprising:

a plurality of stops, wherein said plurality of stops include said stop; and a plurality of tabs, wherein said plurality of tabs include said tab.

10. The system of claim 9, wherein said plurality of stops includes three stops, and wherein said plurality of tabs includes three tabs, and wherein said freedom of movement is substantially 90 degrees of rotational movement.

11. The system of claim 1, wherein said bearing surface engaging said tab substantially relieves said latch actuator of a force transferred from said latch bolt to said latch actuator.

12. The system of claim 11, wherein said bearing surface is tapered to engage said tab with increasing force as said latch bolt is rotated.

13. The system of claim 1, wherein said tab defines freedom of movement of said latch actuator within said latch cup.

14. The system of claim 1, further comprising:

a seal disposed to discourage matter from infiltrating a space secured by said latch system, wherein said bearing surface engaging said tab provides a compressive force to said seal.

15. The system of claim 14, wherein said seal is disposed between said latch cup and said latch bolt.

16. The system of claim 1, wherein said latch bolt comprises:

a bolt member having a tapered surface to engage a holding surface, wherein said tapered bolt member engaging said holding surface and said bearing surface engaging said tab cooperate to provide increase a holding force of said latch system.

17. The system of claim 1, further comprising:

a spring; and a nib, wherein said spring and said nib cooperate to restrict movement of said latch bolt from at least one of a fully engaged position and a fully disengaged position.

18. The system of claim 17, wherein said spring is fully relaxed when said movement of said latch bolt is restricted in said at least one of a fully engaged position and a fully disengaged position.

19. The system of claim 18, wherein said spring is also fully relaxed substantially throughout a freedom of movement of said latch bolt.

20. The system of claim 17, wherein said spring is disposed on said latch bolt.

21. The system of claim 1, further comprising:

a lock, wherein said latch actuator and said latch cup cooperate to incarcerate said lock.

22. The system of claim 21, wherein each of said latch actuator, said latch bolt, and said lock are comprised of a plastic material.

23. The system of claim 21, wherein said lock comprises:

a lock bolt to allow selective control of movement of said latch actuator.

24. The system of claim 23, wherein said latch cup comprises:

a groove disposed to cooperate with said lock bolt to allow free movement of said latch actuator when said lock is disposed in a disengaged orientation, and to cooperate with said lock bolt to restrict movement of said latch actuator when said lock is disposed in an engaged orientation.

25. The system of claim 1, wherein said latch system is disposed in a hatch door, and wherein said latch cup is formed integral to said hatch door.

26. The system of claim 1, further comprising:

a first sealing ring disposed between said latch actuator and said latch cup.

27. The system of claim 26, further comprising:

a second sealing ring disposed between said latch actuator and said latch cup.

28. A method for latching a panel in a closed position comprising:

providing a latch cup in said panel, wherein said latch cup includes a via there through;

disposing a latch actuator in said latch cup;

disposing a seal between said latch cup and said latch actuator;

coupling a latch bolt to said latch actuator through said via, wherein said step of coupling said latch bolt to said latch actuator provides a relaxed interface between said latch actuator and said seal;

providing a first stop associated with a fully disengaged position of said latch bolt;

providing a second stop associated with a fully engaged position of said latch bolt;

manipulating said latch actuator to cause movement of said latch bolt from said fully disengaged position to said fully engaged position when said panel is in a closed position to thereby engage said latch bolt to provide a holding force; and providing a bearing surface disposed such that a compressive force at least in part compressing said seal is provided by another surface interfacing with said bearing surface as said latch bolt is moved to said fully engaged position.

29. The method of claim 28, wherein said latch cup is provided integral to said panel.

30. The method of claim 28, wherein said panel is a hatch door.

31. The method of claim 28, wherein said step of disposing said latch actuator in said latch cup comprises:

nesting said latch actuator into said latch cup such that said latch actuator does not protrude above an upper surface of said latch cup.

32. The method of claim 28, wherein said step of disposing a seal between said latch cup and said latch actuator comprises:

providing a seal groove in at least one of said latch cup and said latch actuator to thereby accept said seal.

33. The method of claim 28, wherein said step of disposing a seal between said latch cup and said latch actuator comprises:

disposing a plurality of seals between said latch cup and said latch actuator.

34. The method of claim 28, wherein said step of manipulating said latch actuator comprises:

compressing said seal with substantially equal force as said latch bolt is moved to said fully engaged position.

35. The method of claim 28, further comprising:

providing a tab disposed to cooperate with at least one of said first and second stops to thereby limit movement of said latch bolt, wherein said tab further includes said surface interfacing with said bearing surface to provide said compressive force.

36. The method of claim 34, wherein said latch bolt includes a bolt member having a tapered surface, and wherein said step of compressing said seal comprises:

interfacing said tapered surface with a holding surface such that a compressive force at least in part compressing said seal is provided by said tapered surface interfacing with said holding surface.

37. The method of claim 28, further comprising:

incarcerating a lock between said latch actuator and said latch cup.

38. The method of claim 37, further comprising:

providing a groove in said latch cup to cooperate with said lock, wherein said groove and said lock restrict operation of said latch actuator when said lock is disposed in a first orientation and said groove and said lock permit operation of said latch actuator when said lock is disposed in a second orientation.

39. The method of claim 38, wherein said groove includes an engagement stop and a disengagement stop, further comprising:

manipulating said lock such that a bolt of said lock contacts said engagement stop to thereby place said lock in said first orientation; and manipulating said lock such that a bolt of said lock contacts said disengagement stop to thereby place said lock in said second orientation.

40. A hatch latchable in a closed position comprising:

a hatch door having a latch cup formed integrally therein and providing a via through said hatch door, wherein said latch cup includes a plurality of tabs disposed at predetermined positions on a first side of said latch cup;

a latch actuator disposed in said latch cup, wherein said latch actuator includes a handle portion integral therewith which does not substantially protrude beyond said latch cup throughout operation of said latch actuator; and a latch bolt coupled to said latch actuator through said via, wherein said latch bolt includes a plurality of stops disposed at predetermined positions on a first side of said latch bolt to interface with said tabs provided on said latch cup in at least one point throughout said operation of said latch actuator, wherein said latch bolt includes a bolt member having a tapered surface to engage a holding surface.

41. The hatch of claim 40, further comprising:

a seal disposed between said latch cup and said latch actuator.

42. The hatch of claim 41, wherein said latch cup comprises:

a groove adapted to receive said seal.

43. The hatch of claim 41, herein said latch actuator comprises:

a groove adapted to receive said seal.

44. The hatch of claim 41, wherein said interfacing of said tabs and said stops cooperate to provide a substantially equal compression force to said seal.

45. The hatch of claim 40, wherein said interfacing of said tabs and said stops cooperate to transfer a holding force from said latch bolt to said hatch door.

46. The hatch of claim 45, wherein said interfacing of said tabs and said stops further cooperate to define a freedom of movement of said latch bolt.

47. The hatch of claim 46, wherein said freedom of movement of said latch bolt is approximately 90 degrees.

48. The hatch of claim 46, wherein said freedom of movement of said latch bolt is determined to cooperate with said handle to provide a visual indicator of a status of said latch bolt.

49. The hatch of claim 40, wherein said latch actuator includes an annular lip and said latch cup includes a corresponding groove which cooperate to provide orthogonality to a gap between said latch actuator and said latch cup to thereby discourage the infiltration of matter there between.

50. The hatch of 40, claim wherein said latch bolt includes a spring and nib and said latch cup includes a detent, wherein said spring, nib, and detent cooperate to retain said latch bolt in a predetermined position when a manipulation force is not present.

51. The hatch of claim 40, further comprising:

a lock disposed in said handle portion of said latch actuator, wherein said latch actuator and said latch cup cooperate to incarcerate said lock.

52. The hatch of claim 51, wherein said latch cup includes a recess providing a groove, a first stop, and a second stop, wherein said lock includes a member protruding into said recess and engaging said first stop when said lock is manipulated in a first direction and engaging said second stop when said lock is manipulated in a second direction, wherein said lock and said latch cup cooperate to prevent said latch actuator from free movement except when said lock is in an orientation such that said lock member engages said second stop.

53. A latch system comprising:

a latch actuator, wherein said latch actuator comprises a handle portion;

a latch bolt coupled to said latch actuator;

a latch cup having a size and shape substantially corresponding to a shape of said latch actuator to receive said latch actuator within said latch cup in a nesting relationship, wherein said latch cup includes a via to facilitate said coupling of said latch actuator and said latch bolt;

a stop, wherein said stop defines freedom of movement of said latch actuator within said latch cup; and a tab, wherein said stop includes an engagement stop surface, and a disengagement stop surface, at least one of which engages said tab when said stop defines said freedom of movement of said latch actuator, wherein said stop is disposed on said latch bolt and wherein said tab is disposed on said latch cup.

54. A latch system comprising:

a latch actuator;

a latch bolt coupled to said latch actuator;

a latch cup having a size and shape substantially corresponding to a shape of said latch actuator to receive said latch actuator within said latch cup in a nesting relationship, wherein said latch cup includes a via to facilitate said coupling of said latch actuator and said latch bolt;

a bearing surface; and a tab, wherein said bearing surface is adapted to engage said tab when said latch bolt is disposed in an engaged position, wherein when said bearing surface engages said tab said latch actuator is relieved of a force transferred from said latch bolt to said latch actuator.

55. The system of claim 54, wherein said bearing surface is tapered to engage said tab with increasing force as said latch bolt is rotated.

56. A latch system comprising:

a latch actuator;

a latch bolt coupled to said latch actuator;

a latch cup having a size and shape substantially corresponding to a shape of said latch actuator to receive said latch actuator within said latch cup in a nesting relationship, wherein said latch cup includes a via to facilitate said coupling of said latch actuator and said latch bolt; and a lock, wherein said latch actuator and said latch cup cooperate to incarcerate said lock, wherein each of said latch actuator, said latch bolt, and said lock are comprised of a plastic material.

57. A latch system comprising:

a latch actuator;

a latch bolt coupled to said latch actuator;

a latch cup having a size and shape substantially corresponding to a shape of said latch actuator to receive said latch actuator within said latch cup in a nesting relationship, wherein said latch cup includes a via to facilitate said coupling of said latch actuator and said latch bolt; and a lock, wherein said latch actuator and said latch cup cooperate to incarcerate said lock, wherein said lock comprises a lock bolt to allow selective control of movement of said latch actuator, wherein said latch cup comprises a groove disposed to cooperate with said lock bolt to allow free movement of said latch actuator when said lock is disposed in a disengaged orientation, and to cooperate with said lock bolt to restrict movement of said latch actuator when said lock is disposed in an engaged orientation.

58. A method for latching a panel in a closed position comprising:

providing a latch cup in said panel, wherein said latch cup includes a via there through;

disposing a latch actuator in said latch cup;

disposing a seal between said latch cup and said latch actuator;

coupling a latch bolt to said latch actuator through said via, wherein said latch bolt includes a bolt member having a tapered surface, wherein said step of coupling said latch bolt to said latch actuator provides a relaxed interface between said latch actuator and said seal;

providing a first stop associated with a fully disengaged position of said latch bolt;

providing a second stop associated with a fully engaged position of said latch bolt; and manipulating said latch actuator to cause movement of said latch bolt from said fully disengaged position to said fully engaged position when said panel is in a closed position to thereby engage said latch bolt to provide a holding force, wherein said step of manipulating said latch actuator comprises compressing said seal with substantially equal force as said latch bolt is moved to said fully engaged position, and wherein said step of compressing said seal comprises interfacing said tapered surface with a holding surface such that a compressive force at least in part compressing said seal is provided by said tapered surface interfacing with said holding surface.

59. A method for latching a panel in a closed position comprising:

providing a latch cup in said panel, wherein said latch cup includes a via there through;

disposing a latch actuator in said latch cup;

disposing a seal between said latch cup and said latch actuator;

coupling a latch bolt to said latch actuator through said via;

providing a first stop associated with a fully disengaged position of said latch bolt;

providing a second stop associated with a fully engaged position of said latch bolt;

manipulating said latch actuator to cause movement of said latch bolt from said fully disengaged position to said fully engaged position when said panel is in a closed position to thereby engage said latch bolt to provide a holding force;

incarcerating a lock between said latch actuator and said latch cup; and providing a groove in said latch cup to cooperate with said lock, wherein said groove and said lock restrict operation of said latch actuator when said lock is disposed in a first orientation and said groove and said lock permit operation of said latch actuator when said lock is disposed in a second orientation.

60. The method of claim 59, wherein said groove includes an engagement stop and a disengagement stop, further comprising:

manipulating said lock such that a bolt of said lock contacts said engagement stop to thereby place said lock in said first orientation; and manipulating said lock such that a bolt of said lock contacts said disengagement stop to thereby place said lock in said second orientation.

61. A hatch latchable in a closed position comprising:

a hatch door having a latch cup formed integrally therein and providing a via through said hatch door, wherein said latch cup includes a plurality of tabs disposed at predetermined positions on a first side of said latch cup;

a latch actuator disposed in said latch cup, wherein said latch actuator includes a handle portion integral therewith which does not substantially protrude beyond said latch cup throughout operation of said latch actuator;

a latch bolt coupled to said latch actuator through said via, wherein said latch bolt includes a plurality of stops disposed at predetermined positions on a first side of said latch bolt to interface with said tabs provided on said latch cup in at least one point throughout said operation of said latch actuator; and a seal disposed between said latch cup and said latch actuator, wherein said interfacing of said tabs and said stops cooperate to provide a substantially equal compression force to said seal.

62. A hatch latchable in a closed position comprising:

a hatch door having a latch cup formed integrally therein and providing a via through said hatch door, wherein said latch cup includes a plurality of tabs disposed at predetermined positions on a first side of said latch cup;

a latch actuator disposed in said latch cup, wherein said latch actuator includes a handle portion integral therewith which does not substantially protrude beyond said latch cup throughout operation of said latch actuator, wherein said latch actuator includes an annular lip and said latch cup includes a corresponding groove which cooperate to provide orthogonality to a gap between said latch actuator and said latch cup to thereby discourage the infiltration of matter there between; and a latch bolt coupled to said latch actuator through said via, wherein said latch bolt includes a plurality of stops disposed at predetermined positions on a first side of said latch bolt to interface with said tabs provided on said latch cup in at least one point throughout said operation of said latch actuator.

63. A hatch latchable in a closed position comprising:

a hatch door having a latch cup formed integrally therein and providing a via through said hatch door, wherein said latch cup includes a plurality of tabs disposed at predetermined positions on a first side of said latch cup;

a latch actuator disposed in said latch cup, wherein said latch actuator includes a handle portion integral therewith which does not substantially protrude beyond said latch cup throughout operation of said latch actuator; and a latch bolt coupled to said latch actuator through said via, wherein said latch bolt includes a plurality of stops disposed at predetermined positions on a first side of said latch bolt to interface with said tabs provided on said latch cup in at least one point throughout said operation of said latch actuator, wherein said latch bolt includes a spring and nib and said latch cup includes a detent, wherein said spring, nib, and detent cooperate to retain said latch bolt in a predetermined position when a manipulation force is not present.

64. A hatch latchable in a closed position comprising:

a hatch door having a latch cup formed integrally therein and providing a via through said hatch door, wherein said latch cup includes a plurality of tabs disposed at predetermined positions on a first side of said latch cup;

a latch actuator disposed in said latch cup, wherein said latch actuator includes a handle portion integral therewith which does not substantially protrude beyond said latch cup throughout operation of said latch actuator;

a latch bolt coupled to said latch actuator through said via, wherein said latch bolt includes a plurality of stops disposed at predetermined positions on a first side of said latch bolt to interface with said tabs provided on said latch cup in at least one point throughout said operation of said latch actuator; and a lock disposed in said handle portion of said latch actuator, wherein said latch actuator and said latch cup cooperate to incarcerate said lock.

65. The hatch of claim 64, wherein said latch cup includes a recess providing a groove, a first stop, and a second stop, wherein said lock includes a member protruding into said recess and engaging said first stop when said lock is manipulated in a first direction and engaging said second stop when said lock is manipulated in a second direction, wherein said lock and said latch cup cooperate to prevent said latch actuator from free movement except when said lock is in an orientation such that said lock member engages said second stop.

* * * * *